US006099109A

United States Patent [19]

Komuro

[11] Patent Number: 6,099,109

[45] **Date of Patent: *Aug. 8, 2000**

[54] LIQUID-EJECTING HEAD AND METHOD OF MANUFACTURING THE SAME

[75] Inventor: Hirokazu Komuro, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/902,325

[22] Filed: Jul. 29, 1997

[30] Foreign Application Priority Data

Jul. 31, 1996 [JP] Japan ..... 8-202447

[51] Int. Cl.[7] ..... B41J 2/14

[52] U.S. Cl. ..... 347/50

[58] Field of Search ..... 347/50, 58, 19, 347/148

[56] References Cited

U.S. PATENT DOCUMENTS

| | | | |
|---|---|---|---|
| 4,723,129 | 2/1988 | Endo et al. . | |
| 4,860,033 | 8/1989 | Shiozaki et al. . | |
| 4,873,622 | 10/1989 | Komuro et al. | 346/140 R |
| 4,881,318 | 11/1989 | Komuro et al. | 347/58 |
| 4,901,091 | 2/1990 | Kasamoto | 346/140 R |
| 5,322,811 | 6/1994 | Komuro et al. . | |
| 5,343,230 | 8/1994 | Dietl | 347/50 |
| 5,479,197 | 12/1995 | Fujikawa et al. . | |
| 5,485,185 | 1/1996 | Sueoka et al. . | |
| 5,491,505 | 2/1996 | Suzuki et al. . | |
| 5,519,421 | 5/1996 | Barr et al. | 347/47 |
| 5,580,468 | 12/1996 | Fujikawa et al. . | |
| 5,649,359 | 7/1997 | Murakami et al. . | |

FOREIGN PATENT DOCUMENTS

| | | |
|---|---|---|
| 0 705 703 | 4/1996 | European Pat. Off. . |
| 54-59936 | 5/1979 | Japan . |
| 55-27282 | 2/1980 | Japan . |
| 2-16549 | 1/1990 | Japan . |
| 4-175728 | 6/1992 | Japan . |
| 10-000776 | 1/1998 | Japan . |

OTHER PUBLICATIONS

Shirato, Y., et al. "Bubble Jet Printing Technology", J. Institute of Television Engineers of Japan, vol. 37, No. 2, cover, table of contents, and pp. 118–123 (Feb. 1983) (both Japanese original and complete English translation of article) (copies previously submitted).

Shirato, Y., et al. "Bubble Jet Printing Technology", J. Institute of Television Engineers of Japan, vol. 37, No. 2, cover, table of contents, and pp. 118–123 (Feb. 1983) (both Japanese original and complete English translation of article).

*Primary Examiner*—John Barlow
*Assistant Examiner*—Charles W. Stewart, Jr.
*Attorney, Agent, or Firm*—Fitzpatrick, Cella, Harper & Scinto

[57] ABSTRACT

A liquid-ejecting apparatus of the present invention is for ejecting a liquid on a printing medium to print. The apparatus has a carriage that moves along a main-scanning direction, on which a liquid-ejecting head for ejecting the liquid is removably mounted as a removable head or is fixed as a stationary head, a transporting device for transporting the printing medium, a control device for controlling movements of the liquid-ejecting head, the carriage, and the transporting device. The liquid-ejecting head has an ejection element portion that includes an energy-generating device for ejecting a liquid, a plurality of ejection orifices positioned in a direction perpendicular to the energy-generating device, and a wiring device for sending an electrical signal to the energy-generating device, an exterior wiring portion for applying the electric signal to the wiring device of the ejection element portion, an electrically connected portion where the wiring device and the exterior wiring portion are electrically connected together, and a sealing resin portion that seals the electrically connected portion.

21 Claims, 9 Drawing Sheets

LIQUID-EJECTING HEAD AND METHOD OF MANUFACTURING THE SAME

BACKGROUND OF THE INVENTION

1. Field of the Invention

The present invention relates to a liquid-ejecting head that ejects a droplet of required liquid by generating an air bubble by the action of thermal energy on the liquid. The present invention also relates to a method of manufacturing such liquid-ejecting head, a liquid-ejecting apparatus, and a printing system using such liquid-ejecting apparatus as an output device.

2. Description of the Related Art

Heretofore, an ink-jet printing method, the so-called bubble-jet printing method, has been well-known in the generic public. The method comprises the steps of providing an ink with an energy such as a thermal energy to cause abrupt volume variation (generation of bubble) of the ink, and of ejecting the ink through ejection ports by an acting force on the basis of the state variation to deposit the ejected ink on a printing medium to form an image. The method has been used in: a printer as an output device of a data-processing apparatus such as a copy machine, a facsimile machine, an electronic typewriter, and a word processor; a printer as an output terminal of work station or the like; and a handy- or potable-printer of a personal computer, a host computer, an optical disk apparatus, a video apparatus, or the like. The ink-jet printing method is responsible for printing textual information and pictorial information on a printing medium by ejecting ink droplets on the printing medium, so that it has the excellent advantages of printing images with extraordinary definition and printing at high speed. In a liquid-ejecting head that employs the ink-jet printing method, ejection ports for ejecting the ink, ink passages communicating with the ejection ports, and electrothermal transducers as energy generating means for ejecting ink in the ink passages are typically arranged as disclosed in Japanese Patent Application Publication Nos. 61-59911 (1986) and 61-59914 (1986), U.S. Pat. No. 4,723,129, and the like.

The printing apparatus (hereinafter, also referred as the ink-jet printing apparatus) adopting the ink-jet printing method equips a removable or stationary liquid-ejecting head, and it shows the abilities of printing with a low noise level compared with that of the other apparatuses using the different printing methods because of: its non-impact printing system; printing a multicolor picture(both alphanumeric and graphic output in multiple colors) by using a set of different colored inks; and printing images with extraordinary definition at high speed. In recent years, therefore, the ink-jet printing method has been employed in a large number of office use apparatuses, such as printers, copy machines, facsimile machines and the like, and furthermore it becomes widely applicable to many industrial systems including a textile printing apparatus.

We are now explaining the method of manufacturing a liquid-ejecting head (hereinafter, also referred as an ink-jet printing head) in brief. In general, the ink-jet printing head is manufactured by the process including the steps of: separately preparing a flow-passage segment for the flow of ink and an ejecting-element segment; and fixing these segments together. To be more specific, for example, the following methods (I) and (II) have been known by the man skilled in the art.

(I) A first method (reference: The Journal of the Institute of Television Engineers of Japan, vol. 37, No. 2, 1983) comprises the steps of: forming a plurality of grooves as ink flow passages on a resin by a pressing technique using a die; forming layers of electrode, thermal resistance, over coat, and the like on a silicon base so as to be face to the grooves; and boding the resin and the silicon base together using a binder.

(II) A second method (reference: Japanese Patent Application Laying-open No. 2-16549 (1990)) comprises the steps of: performing an aeolotropic etching on a surface of a silicon substrate A using potassium hydroxide to form a plurality of grooves as ink flow passages; forming layers of electrode, thermal resistance, over coat, and the like on a silicon base B so as to be face to the grooves of the silicon substrate A; and bonding the silicon base substrates A and B together by anodize process.

One of the concrete examples of the ink-jet printing head manufactured by the above related art will be described below.

An ink-jet printing head in the type of side-shooter comprises: a base substrate on which thermal resistors and wiring conductors for applying current on that thermal resisters; and a top plate (nozzle-formed material) where a plurality of ink flow paths (i.e., nozzles) and their respective ejection orifices are formed.

In addition, there is a thermal resistance layer provided as a thermal resistor, on which an upper protective layer is formed for protecting the thermal resistance layer toward the ink and a lower protective layer is also formed on that layer for storing heart. To be more specific, this kind of the side-shooter type ink-jet printing head can be manufactured by the process comprising the steps:

- patterning a plurality of ink flow paths and their respective ink-ejecting orifices by coating with nozzle-resist subsequently after forming a protective layer on both a thermal resistor provided on a Si-base plate and a wiring conductor for supplying electric-power to the thermal resistor;
- forming a through hole for supplying ink from the underside of the Si-base plate to the right side thereof after that the applied nozzle resist is hardened, and removing the nozzle resist through the hole to complete the above orifices to obtain a printing head board;
- cutting the obtained printing head board to the required length and then plating or forming a ball bump on a pad for TAB-bonding;
- bonding TAB to the obtained printing head for supplying electric-power from the outside source;
- dispensing a sealing resin on a region of the TAB-bonding for an electric insulation of TAB-bonded electric lead and for an improvement of strength of the TAB-bonding region (hereinafter, also referred as an exterior wiring portion); and
- hardening the resin in a furnace to obtain the ink-jet printing head.

For multicolor printing, three ink-jet printing heads are aligned in a row.

However, the ink-jet printing head described above has some problems to be solved as described in below with reference to FIG. 1A and FIG. 1B.

FIG. 1A is a diagrammatic plan view showing a the prime constituents of a liquid-ejecting head in accordance with the related art, and FIG. 1B is a cross sectional view along the line I–I' in FIG. 1A. In these figures, reference numeral 1 denotes a base plate having an ink inlet 12 opened from the underside to the right side thereof, on which an orifice plate 11 is formed so as to face to the ink inlet 12.

As shown in the figures, great attention should be given to the step of dispensing a sealing resin on an exterior wiring portion and its periphery so as to avoid that the sealing resin 21 is spread over the region including thermal resistor elements and ejection orifices 10. If it is not avoided, the sealing resin flows into a part of the orifice 10 or moves too closer to the orifice, causing ejection failure or degradation in ejection performance. This kind of problems should be solved especially when we design a smaller version of the liquid-ejecting head. The base plate size reduction is very important to respond to the demands of cost reduction for the lower prices of the liquid-ejecting head that result from market competition. The reason lies in the process of manufacturing the base plate as a thin film on which the ejecting element portion including thermal resistor elements and the like are formed. The thin-film processing technology permits a cost reduction by reducing the physical size of the base plate. However, the connected portion between the exterior wiring portion and the ejection element portion gets closer to the ejection orifices when the base plate is downsized. Therefore, the step of dispensing a sealing resin on the exterior wiring portion should be performed with a high degree of precision.

For solving the problems associated with the miniaturization of base plate, there is an idea of forming a projection on the ejection element portion to prevent a flow of the sealing resin flows into the orifices. However, the process of forming the projection has some problems. A first problem is that it requires a study of the height of the projection to be required to prevent the flow of sealing resin (i.e., approximately 0.1 mm). As a result, an additional step of forming the projection with high accuracy and an additional cost to prepare the material of protrusion or the like can be required. A second problem is that there is a possibility of preventing a movement of wiping means (such as a blade) by the protrusion and also there is a possibility of causing a wiping failure. The protrusion is formed on an end of the sealed resin region and a part of the blade comes into collision with the protrusion, so that an end portion of the blade is flipped as a result of its elastic property when the blade gets over the protrusion, resulting that the blade cannot wipe the ejection orifices in an appropriate manner. It is noted that there are another troubles to be occurred. For example, the wiping movement on an ink-ejecting surface of the head by means of blade along the nozzle arrangement can be prevented by the inappropriately dispensed sealing resin. Heretofore, accordingly, the condition of dispensed sealing resin is visually checked whether it is allowable or not. If it is not allowable (i.e., an abnormal sealed region is obtained), we judge the condition poor.

As described above, therefore, the process of manufacturing the liquid-ejecting head of the related art has some problems to be solved, including a cost up due to the visual check, reduced yields, and so on.

SUMMARY OF THE INVENTION

An object of the present invention is to provide a liquid-ejecting head having a sealing resin being applied on an appropriate position with a precision never before possible without impairment of the characteristics of the liquid-ejection head, and also to provide a method of manufacturing the liquid-ejecting head, a liquid-ejecting apparatus having the liquid-ejecting head, and a data-processing system using the liquid-ejecting apparatus as an output device.

In a first aspect of the present invention, there is provided a liquid-ejecting head comprising:

an ejection element portion having an energy-generating means for ejecting a liquid, a plurality of ejection orifices positioned in a direction perpendicular to the energy-generating means, and a wiring means for sending an electrical signal to the energy-generating means;

an exterior wiring portion for applying the electric signal to the wiring means of the ejection element portion;

an electrically connected portion where the wiring means and the exterior wiring portion are electrically connected together; and a sealing resin portion that seals the electrically connected portion, wherein a depression region is formed on the ejection element portion so as to be positioned between the plurality of orifices and one end portion of the sealing resin portion positioned between the plurality of orifices and the electrically connected portion, and the depression region limits a position of the one end portion of the sealing resin portion.

Here, the electrically connected portion may be formed on an extension of an arrangement direction of the plurality of orifices, while the depression region is in a shape of rectangular extending to a direction in parallel with the arrangement direction of the plurality of orifices.

The electrically connected portion may be formed on an extension of an arrangement direction of the plurality of orifices, while the depression region is in a shape of rectangular extending to a direction perpendicular to the arrangement direction of the plurality of orifices.

The liquid-ejecting head may further comprise a second depression region formed on the exterior wiring portion for limiting a position of other end of the sealing member.

The second depression region may be in a shape of rectangular extending to a direction perpendicular to the arrangement direction of the plurality of orifices.

The energy-generating means may be an electrothermal transducer that generates heat for causing a film boiling phenomenon in the liquid.

In a second aspect of the present invention, there is provided a method of manufacturing a liquid-ejecting head that has: an ejection element portion having an energy-generating means for ejecting a liquid, a plurality of ejection orifices positioned in a direction perpendicular to the energy-generating means, and a wiring means for sending an electrical signal to the energy-generating means; an exterior wiring portion for applying the electric signal to the wiring means of the ejection element portion; an electrically connected portion where the wiring means and the exterior wiring portion are electrically connected together; and a sealing resin portion that seals the electrically connected portion, comprising a step of:

forming a depression region on the ejection element portion so as to be positioned between the plurality of orifices and one end portion of the sealing resin portion positioned between the plurality of orifices and the electrically connected portion, wherein the depression region limits a position of the one end portion of the sealing resin portion.

Here, the electrically connected portion may be formed on an extension of an arrangement direction of the plurality of orifices, while the depression region is in a shape of rectangular extending to a direction in parallel with the arrangement direction of the plurality of orifices.

The electrically connected portion may be formed on an extension of an arrangement direction of the plurality of orifices, while the depression region is in a shape of rectangular extending to a direction perpendicular to the arrangement direction of the plurality of orifices.

A method of manufacturing a liquid-ejecting head may further comprise a step of forming a second depression region on the exterior wiring portion for limiting a position of other end of the sealing member.

The second depression region may be in a shape of rectangular extending to a direction perpendicular to the arrangement direction of the plurality of orifices.

The energy-generating means may be an electrothermal transducer that generates heat for causing a film boiling phenomenon in the liquid.

In a third aspect of the present invention, there is provided a liquid-ejecting apparatus for ejecting a liquid on a printing medium to print, comprising:

a carriage that moves along a main-scanning direction, on which a liquid-ejecting head for ejecting the liquid is removably mounted as a removable head or is fixed as a stationary head;

a transporting means for transporting the printing medium;

a control means for controlling movements of the liquid-ejecting head, the carriage, and the transporting means, wherein the liquid-ejecting head having:

an ejection element portion having an energy-generating means for ejecting a liquid, a plurality of ejection orifices positioned in a direction perpendicular to the energy-generating means, and a wiring means for sending an electrical signal to the energy-generating means;

an exterior wiring portion for applying the electric signal to the wiring means of the ejection element portion;

an electrically connected portion where the wiring means and the exterior wiring portion are electrically connected together; and a sealing resin portion that seals the electrically connected portion, wherein a depression region is formed on the ejection element portion so as to be positioned between the plurality of orifices and one end portion of the sealing resin portion positioned between the plurality of orifices and the electrically connected portion, and the depression region limits a position of the one end portion of the sealing resin portion.

Here, the electrically connected portion may be formed on an extension of an arrangement direction of the plurality of orifices, while the depression region is in a shape of rectangular extending to a direction in parallel with the arrangement direction of the plurality of orifices.

The electrically connected portion may be formed on an extension of an arrangement direction of the plurality of orifices, while the depression region is in a shape of rectangular extending to a direction perpendicular to the arrangement direction of the plurality of orifices.

A liquid-ejecting apparatus may further comprise a second depression region formed on the exterior wiring portion for limiting a position of other end of the sealing member.

The second depression region may be in a shape of rectangular extending to a direction perpendicular to the arrangement direction of the plurality of orifices.

The energy-generating means may be an electrothermal transducer that generates heat for causing a film boiling phenomenon in the liquid.

The printing medium may be selected from a group of papers, cloth plastic materials, metal materials, leathers, lumber, and ceramic materials.

The liquid-ejecting head may eject different colored liquids onto the printing medium to perform a multicolor printing.

In a fourth aspect of the present invention, there is provided a printing system comprising:

a control portion for processing an input information; and an output means for outputting a processed information from the control portion, wherein the output means is a liquid ejecting apparatus of claim 13.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1A:
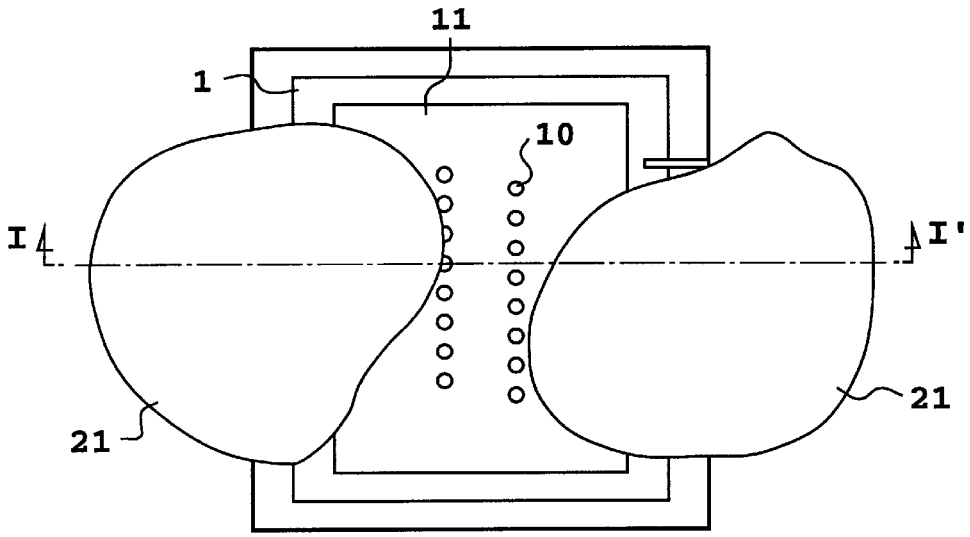
FIG. 1A (PRIOR ART)
FIG. 1A is a diagrammatic plan view showing the prime constituents of a liquid-ejecting head in accordance with the related art.

The present invention is applicable to a printer performing printing on a printing medium, such as paper, yarn, fiber, cloth, leather, metal, plastic, glass, wood, ceramic or the like, a copy machine, a facsimile machine having a communication system, a word processor having a printing portion and the like, and further to an industrial printing apparatus which is able to compose to various processing devices.

It should be noted that, in the present invention, a word "print" not only means forming a meaningful image per se, such as character, drawing and the like, but also means forming a meaningless image, such as a pattern.

It should be also noted that, in the present invention a term "printing apparatus" or "liquid-ejecting apparatus" means a printer performing printing on a printing medium, such as paper, yarn, fiber, cloth, leather, metal, plastic, glass, wood, ceramic or the like, a copy machine, a facsimile machine having a communication system, a word processor having a printing portion and the like, and further to an industrial printing apparatus which is able to compose to various processing devices.

Hereinafter, we will describe preferred embodiments of the present invention with reference to the drawings, wherein like reference characters designate like or corresponding parts throughout.

(Embodiment 1)

Figure 2A:
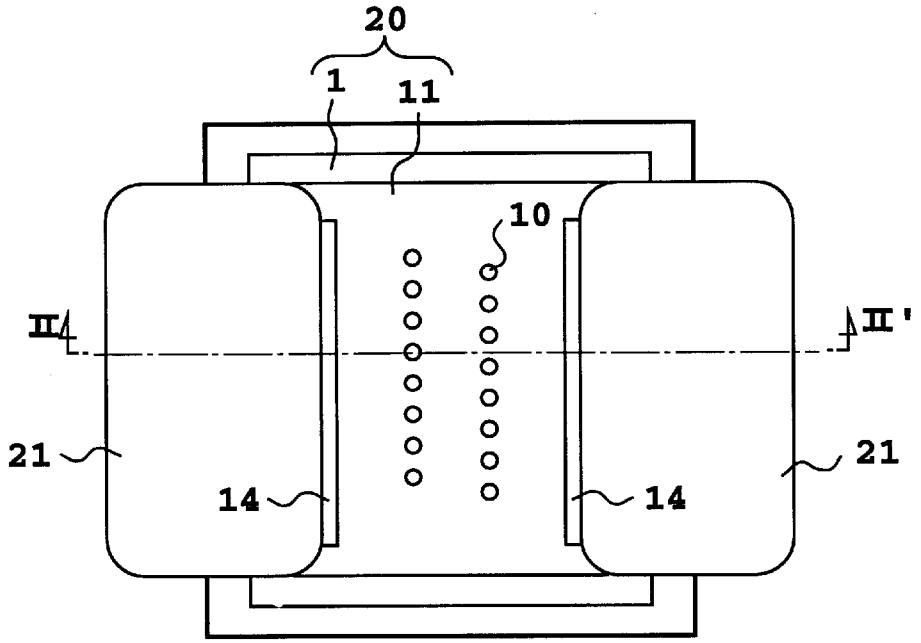
FIG. 2A is a plan view showing the prime constituents of a liquid-ejecting head of the present embodiment.
Figure 2B:
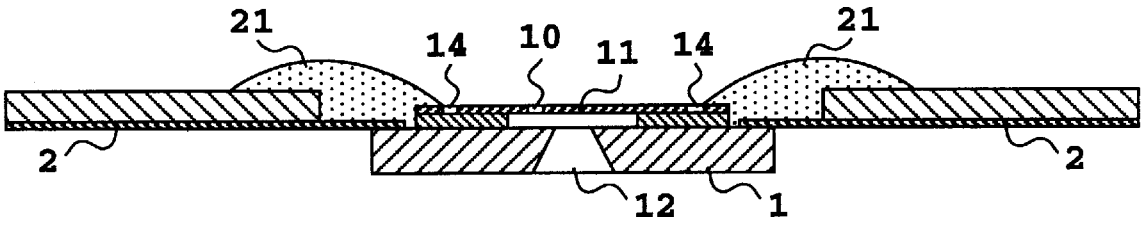
FIG. 2B is a cross sectional view along the line II–II' in FIG. 2A.

FIG. 2A is a plan view showing a main part of a liquid-ejecting head of the present embodiment, and FIG. 2B is a cross sectional view along the line II–II' in FIG. 2A.

In the figures, the reference numeral 1 denotes a heater board on which a plurality of heater elements (not shown) and an ink-supplying opening 12 are formed. Also, the reference numeral 11 denotes an orifice plate having a plurality of ink-ejecting orifices is formed. Furthermore, the reference numeral 2 is an exterior wiring portion forming an electrically connected region by connecting to a wiring conductor to supply electrical power to heater element, and also the reference numeral 21 denotes a sealing resin that seals the electrically connected region.

Hereinafter, we will explain the process of manufacturing the liquid-ejecting head described above.

At first, a heater element layer and an electrode layer are formed on a silicon base and a heater element region is formed thereon by photolithography. A protective layer is then formed, and subsequently a hole is formed by photolithography on a portion to be electrically connected. In this embodiment, a gold is used as a metal of electrical connection for electrically connecting to the exterior wiring portion 2 by a lead beam. Then a pad is formed on the electrical connected region by photolithography, resulting in completion a heater board 1. For forming an ink-supplying opening 12, a hole is formed in the silicon base by means of blasting. An ink flow path is formed by photolithography using a dry film. After that, an orifice plate 11 formed by electro-casting is welded on the heater board 1 to complete an ejection element portion 20. The orifice plate 11 formed by electro-casting has a groove of 0.1 mm in width as a depression region 14 which is 1 mm away from the ejection port 10 toward the electrically connected region. In this embodiment, a thickness of the orifice plate is 60 $\mu$m and a depth of the depression region 14 is 60 $\mu$m.

The exterior wiring portion 2 includes an electrical wiring of copper formed on a polyimide film. This electrical wire connects to the beam lead described above (hereinafter, referred as TAB).

Subsequently, the exterior wiring portion 2 is connected between the beam lead and an electric pad of the heater board 1.

Figure 1B:
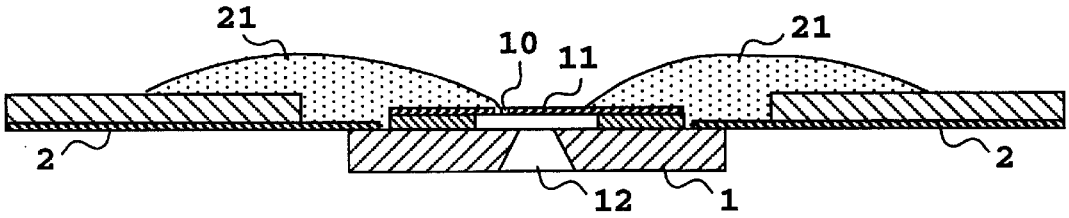
FIG. 1B (PRIOR ART)
FIG. 1B is a cross sectional view along the line I–I' in FIG. 1A.

After that, the ejection element portion 20 and the exterior wiring portion 2 are sealed with a sealing resin 21 with an aide of dispenser. A thickness of the sealed resin is 0.5 mm. As shown in FIG. 1, a broad area of the sealed resin is limited by a side edge of the depression region 14 and its surface tension, so that the sealed region can be defined by forming the depression region 14 with great precision. It means that a distance from the ejection orifice to an edge of the sealed region can be also kept at a constant with great precision. According to the present embodiment, therefore, a region of the sealed region can be controlled, minimizing the risk of causing any troubles between the sealed resin and the ejection orifice. Consequently, it avoids a failure of sealing the ejection element portion and the exterior wiring portion, and also it permits a smaller version of the substrate without increasing cost of manufacturing the liquid-ejecting head because of simultaneously forming the ejecting orifices and the depression region of the orifice plate in the step of preparing the orifice plate.

In the present embodiment, furthermore, there is no protruded portion on an end of the sealed region, so that a blade member or the like does not bump on the sealed region's end portion.

In summary, the liquid-ejecting head of the present embodiment has the depression region in the molded material where a plurality of ejection orifices is formed as the ejection element portion, so that a region of the sealed resin of the ejection element portion can be adjusted with precision. In addition, a region of the sealed region of the exterior wiring portion can be also adjusted with precision because of forming the depressed region for defining an end of the sealed resin's region.

As shown in FIGS. 2A and 2B, a broad area of the sealed resin can be defined with precision by utilizing the fact that the spread of the required can be stopped at a side edge of the depression region 14 with the aid of a surface tension of the sealed region.

In the step of forming a depression region 14 in the molded material in which a plurality of ejection orifices is formed, holes are formed in an orifice plate with a pattern of plated resist in the case of using the electroformed orifice plate. In the step of integrally forming a plurality of ejection orifices with their respective nozzles on the substrate, it is possible to form the depression region at the time of patterning the ejection orifices.

Consequently, the present embodiment is able to provide the liquid-ejecting head by photolithography without require any redundant step, so that the depression region can be formed on the order of micrometers.

In the step of forming the depression region in the exterior wiring portion, the depression region can be formed by forming a hole in a base film of TAB to be used as the exterior wiring portion. Making the hole in the TAB's base film is performed simultaneously with making a hole for positioning the chip. The hole can be formed by blanking or photolithography with an accuracy of the order of 0.1 mm.

(Embodiment 2)

Figure 3A:
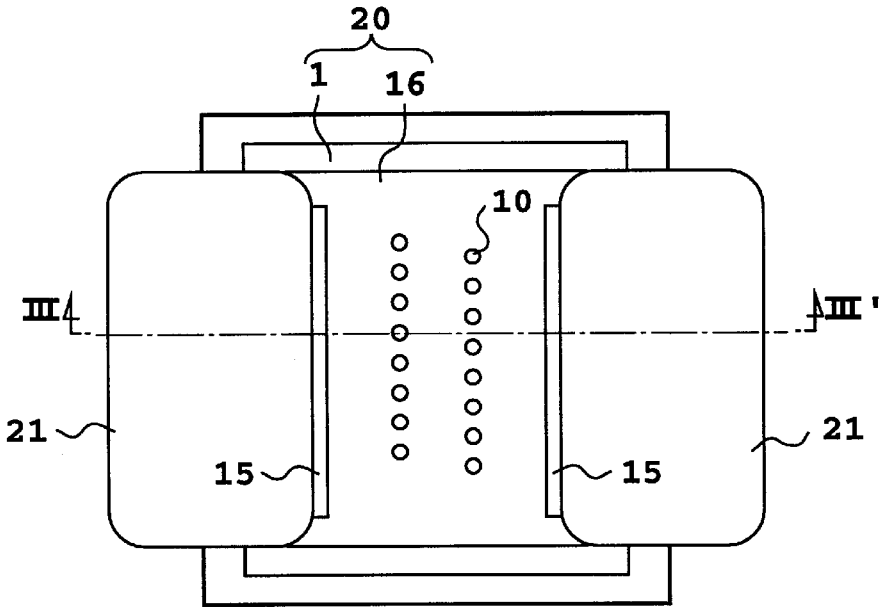
FIG. 3A is a plan view showing the prime constituents of a liquid-ejecting head of the present embodiment.

FIG. 3A is a plan view for a brief explanation of a main part of a liquid-ejecting head of the present embodiment, while FIG. 2B is a cross sectional view along the line III–III' of FIG. 3A.

A liquid-ejecting head of the present embodiment has an ejection element portion where nozzles and their respective ejection orifices 10 are integrally formed on a substrate.

In the present embodiment, the liquid-ejecting head is manufactured by the following steps.

A first step is to prepare a substrate by the same way as that of Embodiment 1. Then a mold material for molding ink flow paths is applied on the substrate to make a pattern of ink flow paths. After that, a mold material 16 for molding walls of ink flow paths and an orifice plate is further applied followed by patterning the material. At this time, a groove of 0.5 mm in width is formed as a depression region 15 for defining an end of sealed resin 21. The depression region is 0.05 mm away from the ejection port 10 toward the electrically connected region. In this embodiment, a thickness of the material 16 forming the orifice plate is 30 $\mu$m and a depth of the depression region 14 is 30 $\mu$m.

Figure 3B:
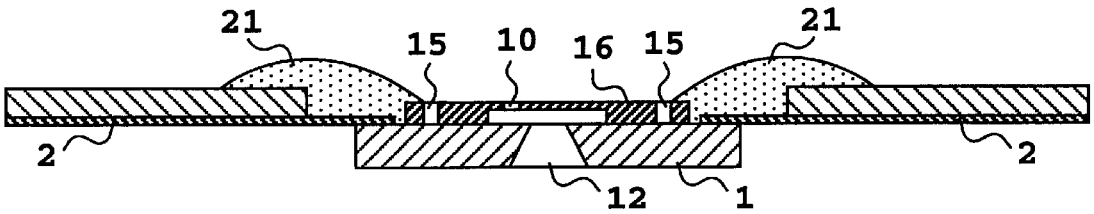
FIG. 3B is a cross sectional view along the line III–III' in FIG. 3A.

Then, an ink inlet 12 is bored in the underside of the base plate by means of anisotropic etching, and then a mold material for forming the ink flow paths is removed to provide an ejection element portion 20 as shown in FIG. 3B.

After that, the TAB as the exterior wiring portion, which is electrically connected to a wiring conductor from the outside, is sealed by a sealing resin.

As shown in FIGS. 3A and 3B, a flow of the sealing resin 21 is stopped at an edge of the depression region by a surface tension of the resin with an accuracy corresponding to a patterning accuracy of the photolithography in the order of μm. In addition, the formation of ejection orifices and the formation of depression region can be performed at the same time, so that there is no need to provide an additional step and to pay an additional manufacturing cost.

The range of the sealing resin can be restricted as described above, the miniaturization of the base plate has allowed in addition to pave the road to avoid the possibility of blocking the ejection orifices by the sealing resin and to avoid the possibility of poorly shaped sealing resin.

In this embodiment, the depression region is in parallel with the arrangement of ejection orifices. However, it is not limited to but it is possible to arrange the depression region in a vertical direction of the arrangement of orifices.

(Embodiment 3)

Figure 4A:
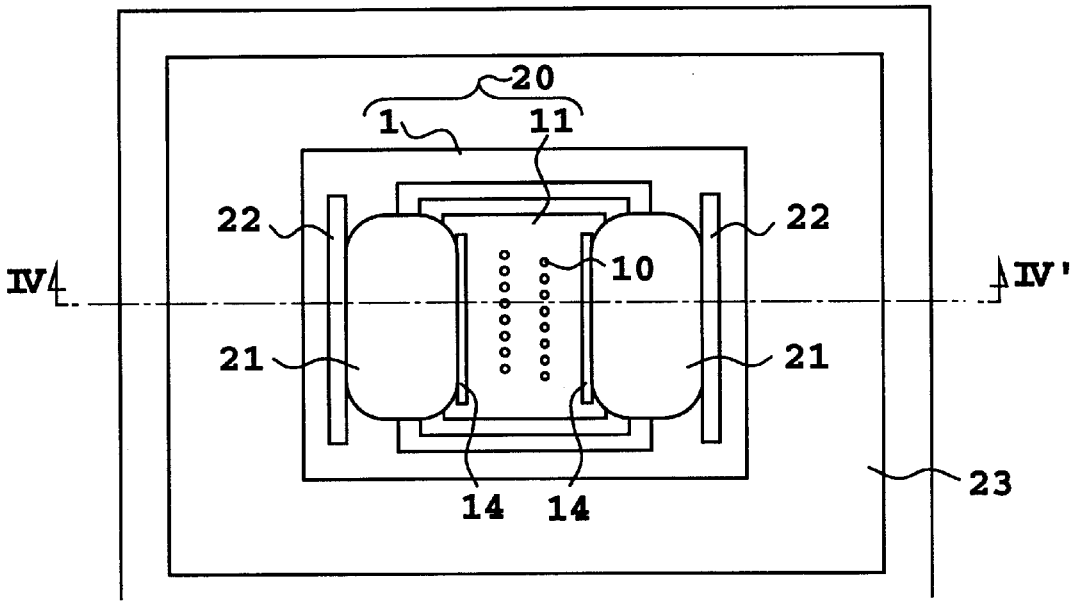
FIG. 4A is a plan view showing the prime constituents of a liquid-ejecting head of the present embodiment.
Figure 4B:
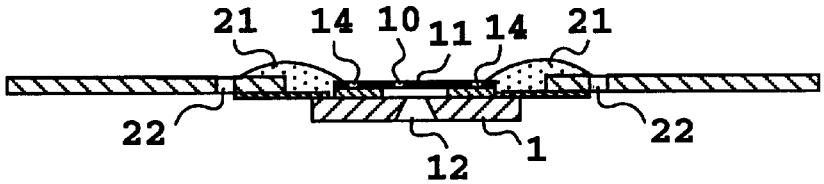
FIG. 4B is a cross sectional view along the line IV–IV' in FIG. 4A.

FIG. 4A is a plan view for a brief explanation of a main part of a liquid-ejecting head of the present embodiment, while FIG. 4B is a cross sectional view along the line IV–IV' of FIG. 4A.

A liquid-ejecting head of the present embodiment has a second depression region in an exterior wiring portion 2 to restrict the range of sealing resin 21.

In the present embodiment, the liquid-ejecting head is manufactured by the following steps.

A first step is to prepare an ejection element portion 20 by the same way as that of Embodiment 1. Then, a groove is formed as a depression region 22 in a base film of a sealing region of TAB to prepare the TAB of the present embodiment. That is, the groove of 0.3 mm in width is provided as the depression region is 1.0 mm away from the ejection port 10 toward the device hole of the TAB. In this embodiment, a thickness of the base plate is 75 μm and a depth of the depression region is 75 μm. After that, the TAB as the exterior wiring portion, which is electrically connected to a wiring conductor from the outside, is sealed by a sealing resin.

As shown in FIGS. 4A and 4B, a flow of the sealing resin 21 is stopped at an edge of the depression region 22 by a surface tension of the resin with a high accuracy, permitting a larger cap region 23 and smaller sized TAB. In addition, the formation of device hole and the formation of depression region can be performed at the same time, so that there is no need to provide an additional step and to pay an additional manufacturing cost.

The range of the sealing resin can be restricted as described above, the miniaturization of the base plate has allowed in addition to pave the road to avoid the possibility of blocking the ejection orifices by the sealing resin and to avoid the possibility of poorly shaped sealing resin.

(Embodiment 4)

Figure 5A:
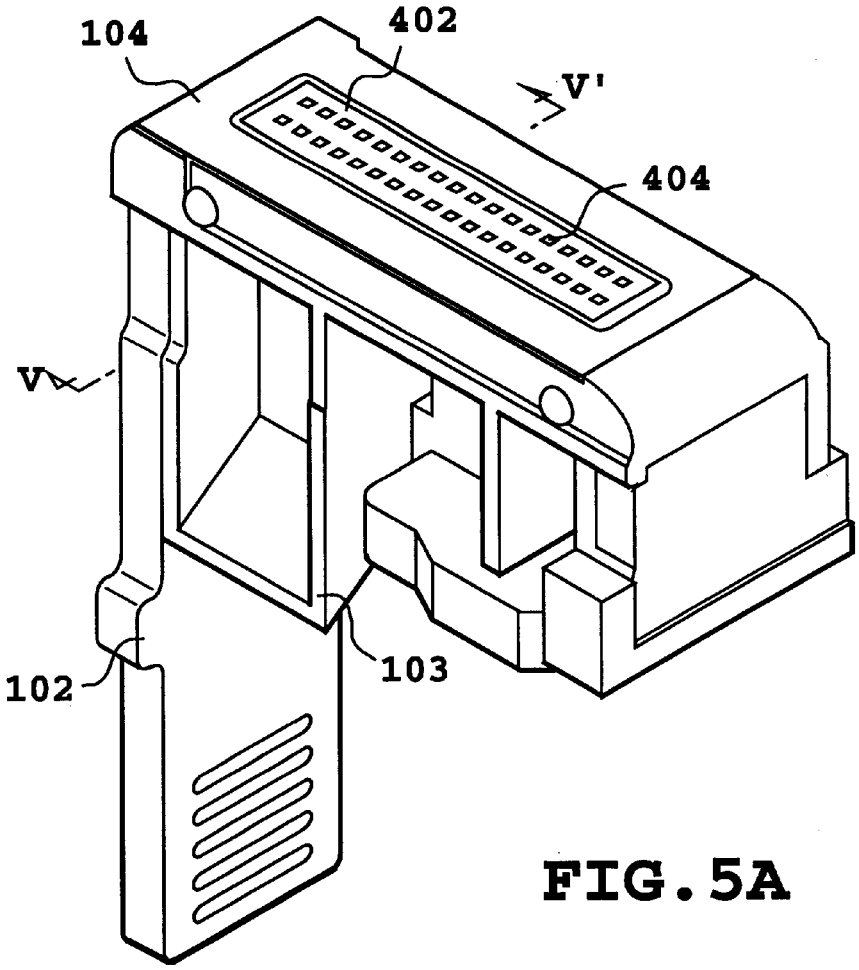
FIG. 5A is a perspective view showing the prime constituents of a liquid-ejecting head of the present embodiment.
Figure 5B:
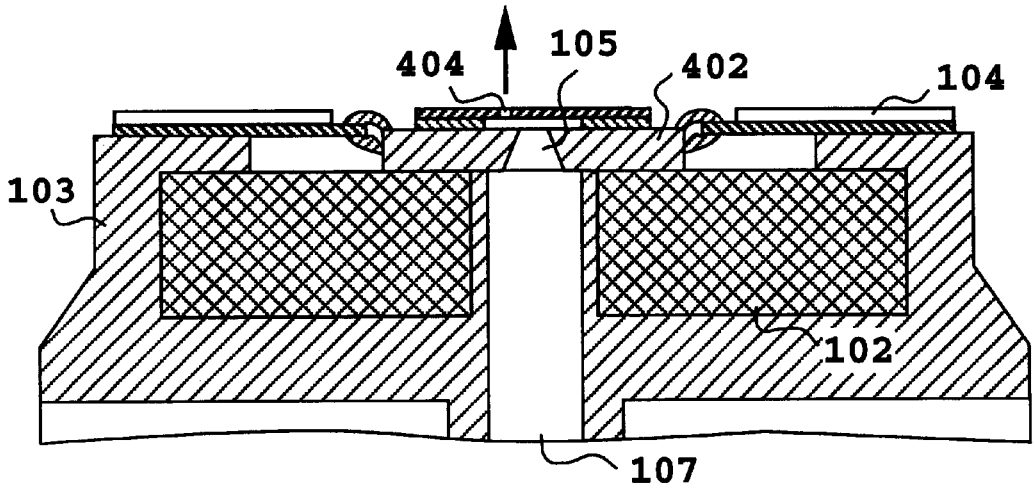
FIG. 5B is a cross sectional view along the line V–V' in FIG. 5A.

FIG. 5A is a perspective view for a brief explanation of a main part of a liquid-ejecting head of the present embodiment corresponding to one of Embodiments 1 to 3, while FIG. 5B is a cross sectional view along the line V–V' of FIG. 5A.

In FIG. 5A and FIG. 5B, the reference numeral 402 denotes a Si element base plate on which heaters as electrothermal transducer elements and ejection orifices are formed by means of thin-film processing technology. As shown in FIG. 5A, furthermore, a plurality of ejection orifices 4 is arranged as two rows of staggered openings in a surface of the element base plate 402 which is cemented to a part of a supporting member 102 in the shape of "L". Likewise, a wiring base 104 is fixed on the supporting member 102. A wiring portion of the wiring base 104 is electrically connected to a wiring portion of the element base plate 402 by bonding. From the view point of cost effectiveness and easiness to process, the supporting member 102 is made of an aluminum material. A molded member 103 is provided for holding the supporting member 102, so that a part of the latter is inserted into an inside of the former. Also, the molded member 103 is provided for 102 for supplying a liquid (such as ink) to a liquid-storing portion (not shown) through a liquid-supplying path 107 formed therein. Furthermore, the molded member 103 acts as a placement and positioning member for removably mounting the liquid-ejecting head on a liquid-ejecting head described later.

An internal portion of the element base plate 402 has a communicating path 105 that passing through the element base plate 402. Also, the communicating path 105 is provided as a common liquid chamber that communicates with each orifice through the liquid flow path.

(Embodiment 5)

Figure 6:
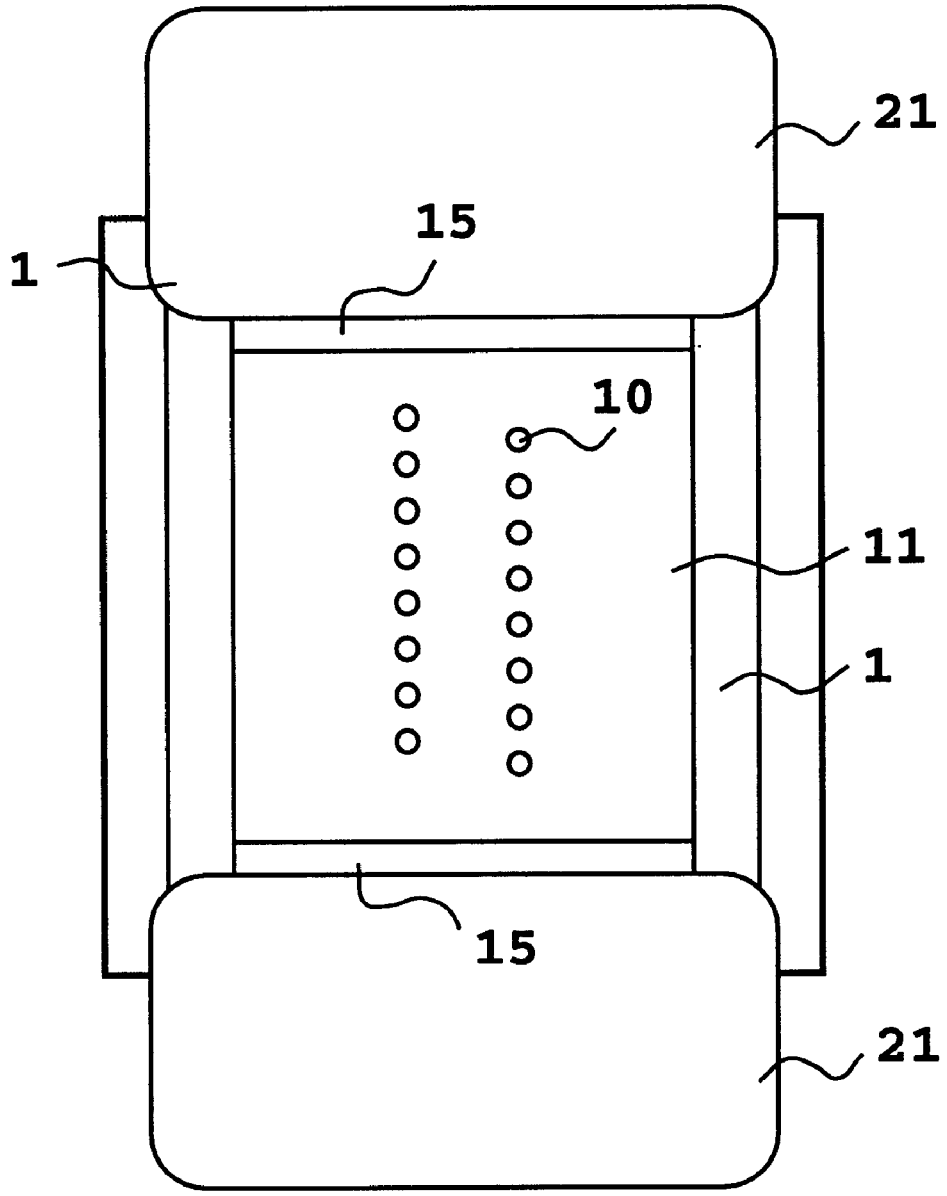
FIG. 6 is a plan view showing the prime constituents of a liquid-ejecting head of the present embodiment.

In Embodiments 1 to 4, the electrically connected portion is positioned in parallel with the direction of an arrangement of a plurality of orifices, so that the depression region is also positioned in parallel with that arrangement. In this embodiment, however, the relationship between the direction of arranging a plurality of orifices and electrically connected portion of FIGS. 3A and 3B is modified as shown in FIG. 6. That is, the electrically connected portion is positioned vertically against the direction of arranging a plurality of orifices, and also the depression region is formed along a line orthogonal to the direction of that arrangement.

(Embodiment 6)

Figure 7:
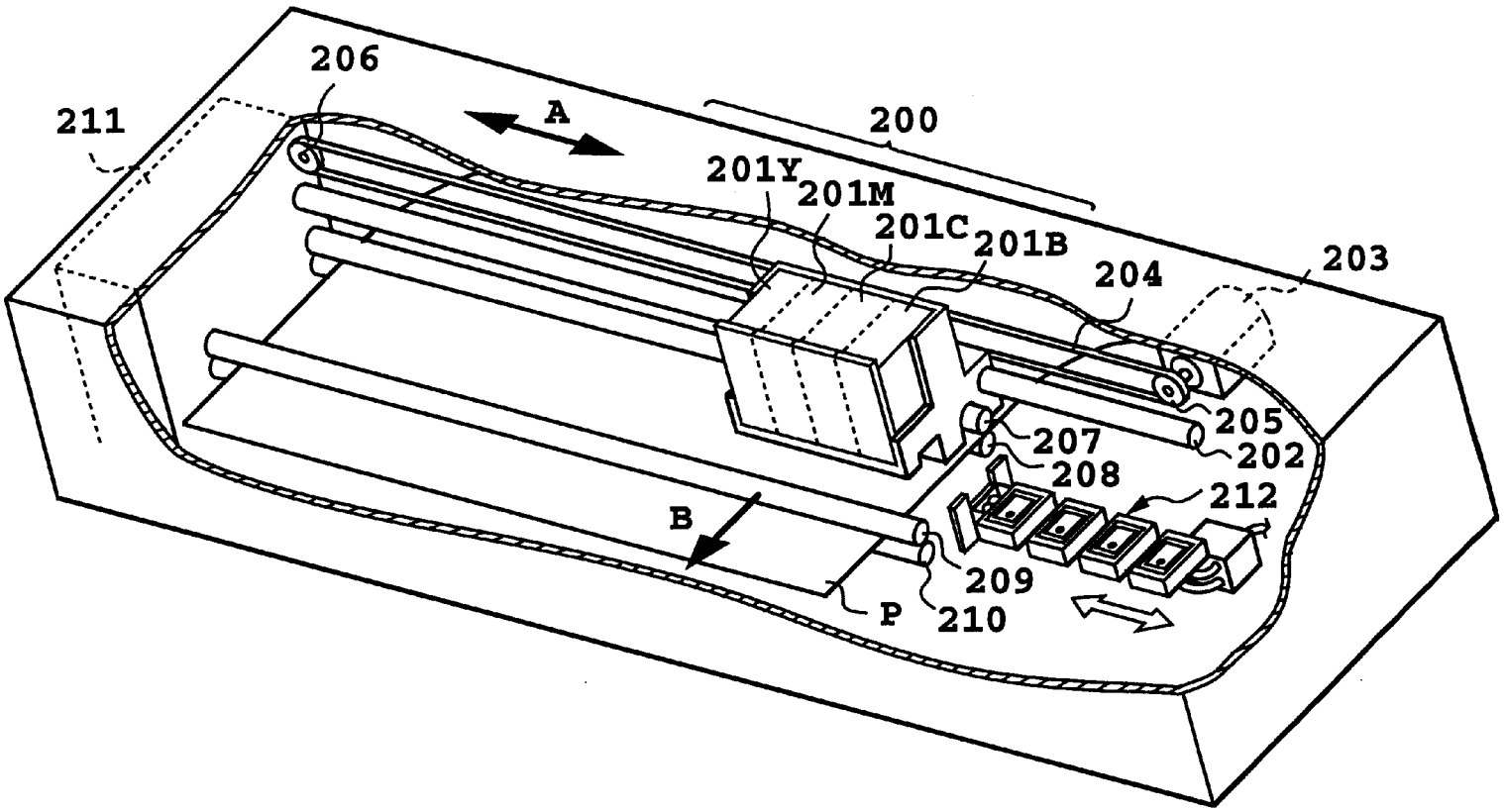
FIG. 7 is a partially cross sectional perspective view showing the prime constituents of a liquid-ejecting apparatus.

Referring now to FIG. 7, we will describe a liquid-ejecting apparatus as one of preferred embodiment of the present invention, on which a liquid-ejecting head of the present invention is removably mounted.

FIG. 7 is a partially sectional perspective view illustrating a general configuration of the liquid-ejecting apparatus of the present invention.

In the figure, the reference numeral 200 denotes a carriage on which the liquid-ejecting head described above is removably mounted. In this embodiment, four different liquid-ejecting heads are mounted on the carriage so as to correspond to different ink colors and these heads connects to their respective ink tanks which are also mounted on the carriage, including a tank 201Y for yellow ink, a tank 201M for magenta ink, a tank 201C for cyan, and a tank 201B for black ink.

The carriage 200 is supported by a guide shaft 202 so as to shift its position as a back-and-forth motion along the guide shaft 202 by forwarding or reversing the direction (along the arrow A in the figure) of rotation of an endless belt 204 by a driving force of a motor 203. As shown in the figure, the endless belt 204 passes over pulleys 205 and 206 to transmit motion of the motor 203.

A sheet of printing paper P is provided as a printing medium and is intermittently transmitted along the direction of arrow B perpendicular to the arrow A. The printing paper P is held at two positions by a pair of roller units 207, 208 on the side of upstream and a pair of roller units 209, 210 on the side of downstream, so that it receives a force tending to stretch the paper to keep its plainness against the head during its movement. Each roller unit receives a driving force from a driving portion 211. Alternatively, the roller unit may receive a driving force from the motor described above. The carriage stops at its home position as necessary during the state of printing or at the time of starting the printing. In this position, there is a cap member for capping an ejection surface of the head. The cap member 212 is connected to a suction recovery device (not shown) for preventing the clogging of the orifice by forcefully sucking the ink from the orifices of the ejection surface.

(Embodiment 7)

Figure 8:
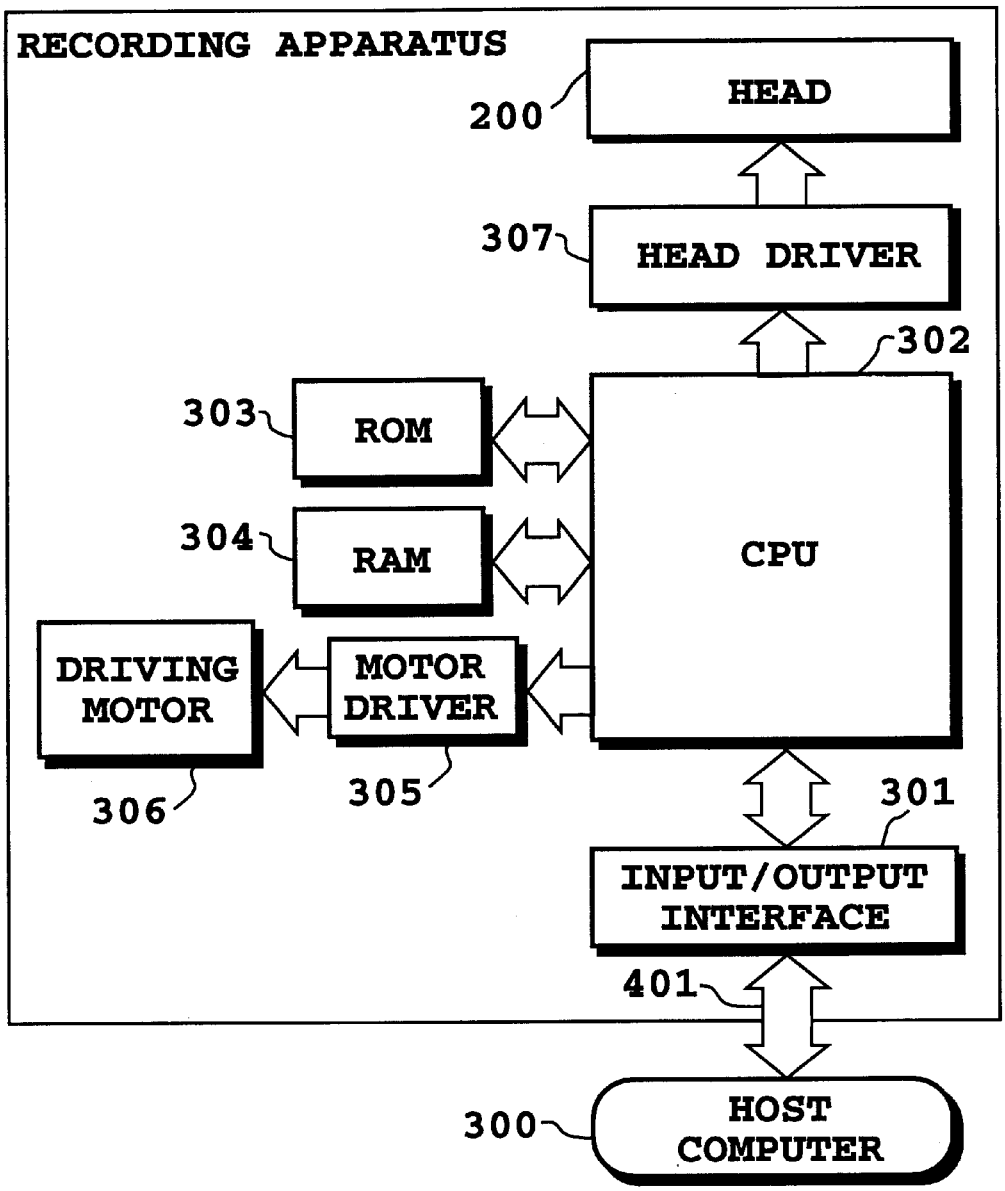
FIG. 8 is a block diagram illustrating a general view of the liquid-ejecting apparatus for operating the printing procedure with ink ejection in which both the liquid-ejection method and the liquid-ejection head of the present invention are applied.

FIG. 8 is a block diagram illustrating a general view of the liquid-ejecting apparatus for operating the printing procedure with ink ejection in which both the liquid-ejection method and the liquid-ejection head of the present invention are applied.

The printing apparatus receives a printing information from a host computer 300 as a control signal. The printing information is temporarily stored in an input interface 301 in the printing apparatus, and in conjunction therewith, converted into data to be process in the printing apparatus and then input to a CPU 302 which, in turn, serves as head driving signal supply means. The CPU processes the input data using RAM 304 and other peripheral units on the basis of the control program stored in a ROM 303 to convert into the printing data (image data).

On the other hand, the CPU 302 generates a drive data for driving the driving motor for shifting the printing medium and the printing head in synchronism with the image data so that the image data may be printed at appropriate position on the printing medium. The driving data and the motor driving data are transmitted to respective of head 200 and the driving motor 306 via a head driver 307 and a motor driver 305 for driving them at respective controlled timing to form the image.

As the printing medium applicable for the printing apparatus set forth above and to deposit the liquid, such as the ink, various paper, OH sheet, plastic material to be employed for a compact disk, decorative panel or the like, cloth, metal materials, such as aluminum, copper or the like, leathers, such as cattle hide, lyophilized porcine skin, simulated synthetic leather substitute, lumber, such as wood, plywood, bamboo, ceramic material, such as tile, three-dimensional structural body, such as sponge or the like, may be used.

The printing apparatus described above may be selected from a printing apparatus for printing on various paper, OH sheet, and the like; a plastic-printing apparatus for printing on a plastic material to be employed for a compact disk, decorative panel or the like; a textile printing apparatus for printing on cloth; a metal-printing apparatus for printing on a metal material; a leather printing apparatus for printing on a leather; lumber-printing apparatus for printing on a lumber; ceramic-printing apparatus for printing on a ceramic material; and a receding apparatus for printing on a three-dimensional structural body.

Also, as the ejection liquid to be used in these liquid ejecting apparatus, the liquid adapted to respective printing medium or printing condition may be used.

(Embodiment 8)

Next, one embodiment of an ink-jet printing system to perform printing for the printing medium with employing the liquid ejecting head according to the present invention as the printing head.

Figure 9:
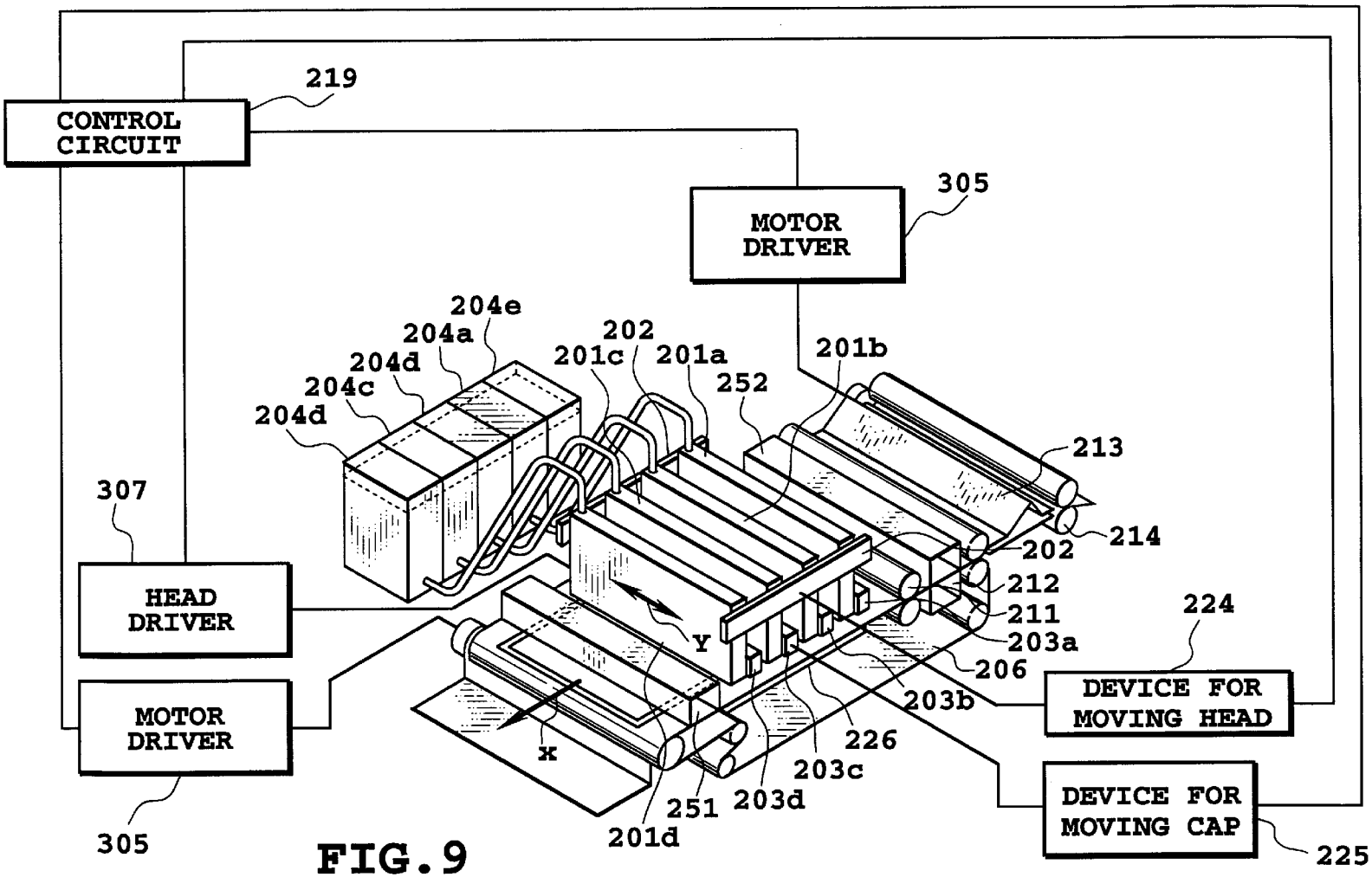
FIG. 9 is a schematic perspective view illustrating the configuration of an ink-jet printing system using the liquid-ejecting head of the present invention.

FIG. 9 is a diagrammatic illustration for explaining the construction of the ink-jet printing system employing the foregoing liquid ejection head 201 according to the present invention. In the present embodiment, the liquid ejecting head is a full-line type head, in which a plurality of ejection ports at interval of 360 dpi in a length corresponding to a printable width of the printing medium 150, in which four heads respectively corresponding to four colors of yellow (Y), magenta (M), cyan (C) and black (Bk) are fixedly supported in parallel relationship with a given interval in X direction by means of a head holder 202.

With respect to these heads, signal is supplied from the head driver 307 forming respective driving signal supply means. On the basis of this signal, respective head is driven.

For respective heads, four colors of inks of Y, M, C and Bk as ejection liquids are supplied from ink containers 204*a* to 204*d*, The reference numeral 204*e* denotes a bubbling liquid container storing the bubbling liquid. From this container, bubbling liquid is supplied to each head.

At lower side of each head, head caps 203*a* to 203*d*, in which ink absorbing member, such as sponge or so forth is arranged are provided for maintenance of the head by covering the ejection ports of respective heads during non-printing.

The reference numeral 206 denotes a transporting belt forming the transporting means for transporting the various printing mediums. The transporting belt 206 runs across a predetermined path defined by various rollers, and is driven by the driving motor connected to the motor driver 305.

In the present embodiment of the ink-jet printing system, before and after printing, a pre-treatment device 251 and a post-treatment device 252 for performing various processes for the printing medium are provided upstream and downstream of the printing medium transporting path.

Content of the pre-treatment and the post-treatment are differentiated depending upon kind of the printing medium and kind of the ink. For example, for the printing medium of metal, plastic, ceramic and the like, irradiation of ultraviolet and ozone is performed by pre-treatment to improve adhesion ability of the ink by making the surface active. When the printing medium (such as plastic) that easily causes static electricity, dust can easily deposit on the surface of the printing medium thereby to obstruct high quality printing. As pre-process, static electricity of the printing medium is removed by ionizer device and whereby dust is removed from the printing medium. Also, when cloth is used as the printing medium, in view point of prevention of bleeding, improvement of fixing rate, a material selected from alkaline material, water soluble material, synthetic high polymer, water soluble metal salt, urea and thiourea may be applied to the cloth for pre-treatment. The pre-treatment is not limited to these treatments but can be the treatment for adjusting the temperature of the printing medium to the appropriate temperature.

On the other hand, the post-treatment may be a heat-treatment for the printing medium, for which the ink is applied, a fixing treatment for promoting fixing of the ink by irradiation of ultraviolet ray or the like, treatment for washing the treatment liquid applied in the pre-treatment and left non-reacted.

It should be noted that the full-line head is employed as the head in the present embodiment. However, the printing head to be employed is not limited to the full-line head but can be in a form where a small size head is shifted in the width direction of the printing medium.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid-ejecting head comprising:

an orifice plate having an array of a plurality of ejection orifices through which a liquid is ejected;

a plurality of energy-generating elements for generating energy to eject the liquid from respective said ejection orifices;

a wiring member for sending an electrical signal to respective said energy-generating elements;

an exterior wiring portion for applying said electrical signal to said wiring member;

an electrically connected portion where said wiring member and said exterior wiring portion are electrically connected together; and a sealing resin that seals said electrically connected portion, wherein a depression region is provided on said orifice plate to extend along said array between said array and said electrically connected portion such that said depression prevents the sealing resin from flowing over said depression to said ejection orifices.

2. A liquid-ejecting head as claimed in claim 1, wherein said electrically connected portion is formed on an extension of an arrangement direction of said plurality of orifices, while said depression region is in a shape of rectangular extending to a direction in parallel with said arrangement direction of said plurality of orifices.

3. A liquid-ejecting head as claimed in claim 1, wherein said electrically connected portion is formed on an extension of an arrangement direction of said plurality of orifices, while said depression region is in a shape of rectangular extending to a direction perpendicular to said arrangement direction of said plurality of orifices.

4. A liquid-ejecting head as claimed in claim 1, further comprising a second depression region formed on said exterior wiring portion for limiting a position of other end of said sealing member.

5. A liquid-ejecting head as claimed in claim 4, wherein said second depression region is in a shape of rectangular extending to a direction perpendicular to said arrangement direction of said plurality of orifices.

6. A liquid-ejecting head as claimed in claim 1, wherein said energy-generating means is an electrothermal transducer that generates heat for causing a film boiling phenomenon in said liquid.

7. A method of manufacturing a liquid-ejecting head that has: an orifice plate having an array of a plurality of ejection orifices through which a liquid is ejected, a plurality of energy-generating elements for generating energy to eject the liquid from respective said ejection orifices, a wiring member for sending an electrical signal to respective said energy-generating elements, an exterior wiring portion for applying said electrical signal to said wiring member, an electrically connected portion where said wiring member and said exterior wiring portion are electrically connected together, and a sealing resin that seals said electrically connected portion, comprising a step of:

providing a depression region on said orifice plate to extend along said array between said array and said electrically connected portion such that said depression prevents the sealing resin from flowing over said depression to said ejection orifices.

8. A method of manufacturing a liquid-ejecting head as claimed in claim 7, wherein said electrically connected portion is formed on an extension of an arrangement direction of said plurality of orifices, while said depression region is in a shape of rectangular extending to a direction in parallel with said arrangement direction of said plurality of orifices.

9. A method of manufacturing a liquid-ejecting head as claimed in claim 7, wherein said electrically connected portion is formed on an extension of an arrangement direction of said plurality of orifices, while said depression region is in a shape of rectangular extending to a direction perpendicular to said arrangement direction of said plurality of orifices.

10. A method of manufacturing a liquid-ejecting head as claimed in claim 7, further comprising a step of forming a second depression region on said exterior wiring portion for limiting a position of other end of said sealing member.

11. A method of manufacturing a liquid-ejecting head as claimed in claim 10, wherein said second depression region is in a shape of rectangular extending to a direction perpendicular to said arrangement direction of said plurality of orifices.

12. A method of manufacturing a liquid-ejecting head as claimed in claim 7, wherein said energy-generating means is an electrothermal transducer that generates heat for causing a film boiling phenomenon in said liquid.

13. A liquid-ejecting apparatus for ejecting a liquid on a printing medium to print, comprising:

a carriage that moves along a main-scanning direction, on which a liquid-ejecting head for ejecting said liquid is removably mounted as a removable head or is fixed as a stationary head;

a transporting means for transporting said printing medium;

a control means for controlling movements of said liquid-ejecting head, said carriage, and said transporting means, wherein said liquid-ejecting head having:

an orifice plate having an array of a plurality of ejection orifices through which a liquid is ejected;

a plurality of energy-generating elements for generating energy to eject the liquid from respective said ejection orifices;

a wiring member for sending an electrical signal to respective said energy-generating elements;

an exterior wiring portion for applying said electrical signal to said wiring member;

an electrically connected portion where said wiring member and said exterior wiring portion are electrically connected together; and a sealing resin that seals said electrically connected portion, wherein a depression region is provided on said orifice plate to extend along said array between said array and said electrically connected portion such that said depression prevents the sealing resin from flowing over said depression to said ejection orifices.

14. A liquid-ejecting apparatus as claimed in claim 13, wherein said electrically connected portion is formed on an extension of an arrangement direction of said plurality of orifices, while said depression region is in a shape of rectangular extending to a direction in parallel with said arrangement direction of said plurality of orifices.

15. A liquid-ejecting apparatus as claimed in claim 13, wherein said electrically connected portion is formed on an extension of an arrangement direction of said plurality of orifices, while said depression region is in a shape of rectangular extending to a direction perpendicular to said arrangement direction of said plurality of orifices.

16. A liquid-ejecting apparatus as claimed in claim 13, further comprising a second depression region formed on said exterior wiring portion for limiting a position of other end of said sealing member.

17. A liquid-ejecting apparatus as claimed in claim 16, wherein said second depression region is in a shape of rectangular extending to a direction perpendicular to said arrangement direction of said plurality of orifices.

18. A liquid-ejecting apparatus as claimed in claim 13, wherein said energy-generating means is an electrothermal transducer that generates heat for causing a film boiling phenomenon in said liquid.

19. A liquid-ejecting apparatus as claimed in claim 13, wherein said printing medium is selected from a group of papers, cloth plastic materials, metal materials, leathers, lumber, and ceramic materials.

20. A liquid-ejecting apparatus as claimed in claim 13, wherein said liquid-ejecting head ejects different colored liquids onto said printing medium to perform a multicolor printing.

21. A printing system comprising:

a control portion for processing an input information; and an output means for outputting a processed information from said control portion, wherein said output means is a liquid ejecting apparatus of claim 13.

* * * * *

UNITED STATES PATENT AND TRADEMARK OFFICE

CERTIFICATE OF CORRECTION

PATENT NO. : 6,099,109
DATED : August 8, 2000
INVENTOR(S) : Hirokazu Komuro

It is certified that error appears in the above-identified patent and that said Letters Patent is hereby corrected as shown below:

TITLE PAGE [56] References Cited:

OTHER PUBLICATIONS, "Shirato, Y., et al. "Bubble Jet Printing Technology", J. Institute of Television Engineers of Japan, vol. 37, No. 2, cover, table of contents, and pp. 118-123 (Feb. 1983) (both Japanese original and complete English translation of article)." should be deleted.

Column 1:
Line 16, "generic" should read -- general --;
Line 27, "potable-printer" should read -- portable-printer --; and
Line 64, "the mem" should read -- those --.

Column 2:
Line 4, "be face to" should read -- face --;
Line 5, "boding" should read -- bonding --;
Line 15, "anodize" should read -- an anodization --; and
Line 61, "a" (2nd occurrence) should be deleted.

Column 3:
Line 7, "closer" should read -- close --;
Line 8, "problems" should read -- problem --; and
Line 52, "cost up" should read -- higher cost --.

Column 4:
Line 27, "angular" should read -- angle --.

Column 5:
Line 46, "angular" should read -- angle --; and
Line 57, "rectangular" should read -- rectangle --.

Column 6:
Line 18, "cross sectional" should read -- cross-sectional --;
Line 22, "cross sectional" should read -- cross sectional --;
Line 26, "cross sectional" should read -- cross sectional --;
Line 30, "cross sectional" should read -- cross sectional --;
Line 36, "cross sectional" should read -- cross sectional --;
Line 40, "cross sectional" should read -- cross sectional --;

UNITED STATES PATENT AND TRADEMARK OFFICE

CERTIFICATE OF CORRECTION

PATENT NO. : 6,099,109
DATED : August 8, 2000
INVENTOR(S) : Hirokazu Komuro

It is certified that error appears in the above-identified patent and that said Letters Patent is hereby corrected as shown below:

Column 7:
Line 1, "cross sectional" should read -- cross-sectional --.

Column 9:
Line 33, "by" should read -- in --; and
Line 62, "cross sectional" should read -- cross-sectional --.

Column 10:
Line 9, "easiness to process," should read -- ease of processing, --;
Line 12, "an" should read -- the --;
Line 49, "connects" should read -- connect --; and
Line 67, "its plainness" should read -- it held --.

Column 13:
Line 26, "rectangular" should read -- rectangle --; and
Line 32, "rectangular" should read -- rectangle --.

Column 14:
Line 2, "rectangluar" should read -- rectangle --; and
Line 9, "rectangular" should read -- rectangle --.

Column 15:
Line 2, "rectangular" should read -- rectangle --; and
Line 10, "rectangular" should read -- rectangle --.

Signed and Sealed this

Fourteenth Day of August, 2001

Nicholas P. Godici

*Attest:*

*Attesting Officer*

NICHOLAS P. GODICI
*Acting Director of the United States Patent and Trademark Office*